United States Patent [19]

Winters

[11] 4,353,381

[45] Oct. 12, 1982

[54] FLUID CLEANER APPARATUS

[76] Inventor: Stephen G. Winters, 6443 S. Broadway, Wichita, Kans. 67214

[21] Appl. No.: 239,120

[22] Filed: Feb. 27, 1981

[51] Int. Cl.[3] ..... B08B 3/02

[52] U.S. Cl. ..... 134/111; 134/102; 134/159

[58] Field of Search ..... 134/94, 102–103, 134/111, 143, 153, 155, 159, 200

[56] References Cited

U.S. PATENT DOCUMENTS

| | | | |
|---|---|---|---|
| 2,520,354 | 8/1950 | Zinty | 134/94 |
| 2,559,472 | 7/1951 | Shanaman | 134/94 |
| 2,567,820 | 9/1951 | Messerschmidt | 134/94 X |
| 2,574,149 | 11/1951 | Kahn | 134/159 X |
| 2,644,472 | 8/1953 | Ward | 134/111 X |
| 2,720,210 | 10/1955 | Lueck | 134/94 |
| 2,788,008 | 4/1957 | Wanzer | 134/155 X |
| 3,285,780 | 11/1966 | Lockerbie | 134/102 |
| 4,029,115 | 6/1977 | Wheeler | 134/111 |
| 4,080,975 | 3/1978 | Williams, Jr. | 134/94 |
| 4,146,404 | 3/1979 | Williams, Jr. | 134/94 |

*Primary Examiner*—Robert L. Bleutge
*Attorney, Agent, or Firm*—Phillip A. Rein

[57] ABSTRACT

The invention is a fluid cleaner apparatus operable to clean automotive parts or the like including (1) a support housing assembly to hold a cleaning fluid therein; (2) a parts support assembly to hold and agitate items to be cleaned; and (3) a fluid actuator assembly operable to (a) supply air pressure to dry items and move the cleaning fluid, and (b) supply and filter the cleaning fluid. The support housing assembly includes a main support housing; a parts support assembly secured to the main support housing operable to receive items thereon for cleaning and drying; and a lid assembly connected to the main support housing operable to enclose same during a cleaning operation for obvious safety reasons. The main support housing includes a parts section mounted on a fluid reservoir section with the fluid actuator assembly operable to force the cleaning fluid from the fluid reservoir section to the desired level. The parts support assembly includes a basket assembly to receive, hold, and rotate the items to be treated in the cleaning fluid. The fluid actuator assembly supplies air pressure to (1) transfer the cleaning fluid between the fluid reservoir section and the parts section; (2) the cleaning fluid to agitate same; and (3) an air hose for removing the cleaning fluid from items that have been treated. Also, the fluid assembly includes a fluid hose member connected to a pump member to selectively supply the cleaning fluid for a rinsing operation if so required.

15 Claims, 11 Drawing Figures

FIG. 4
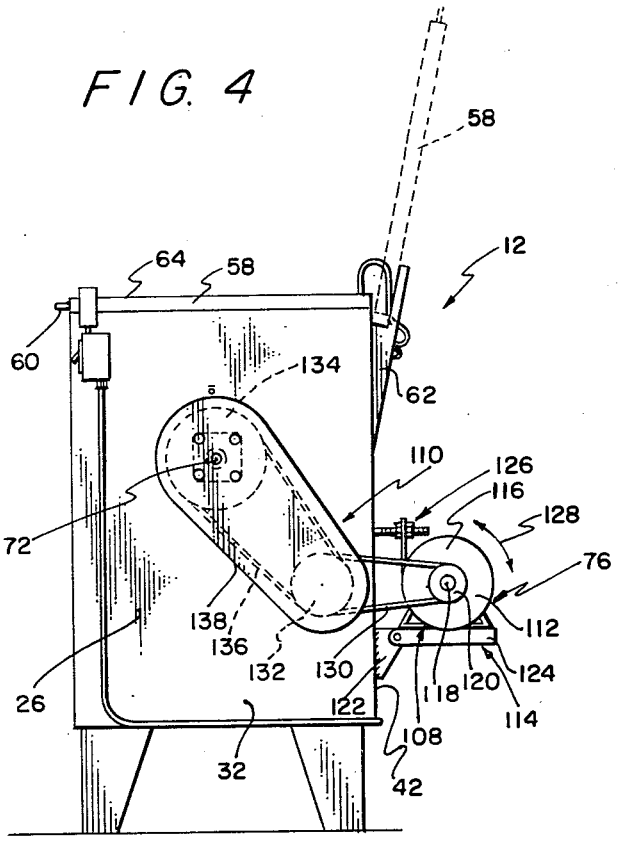
FIG. 5
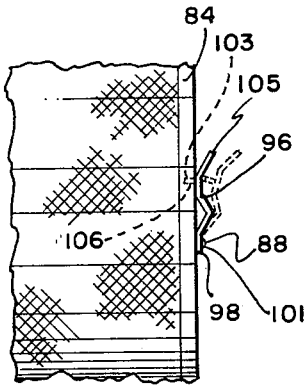
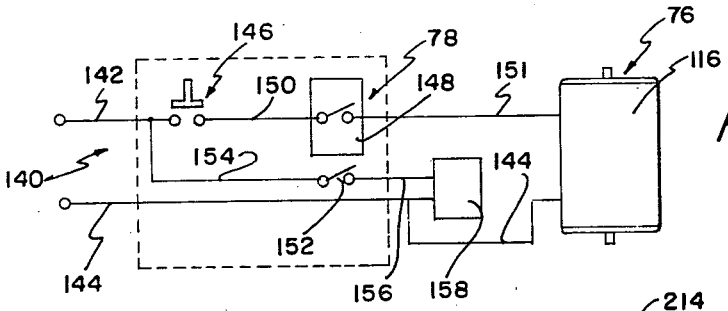
FIG. 6
FIG. 7
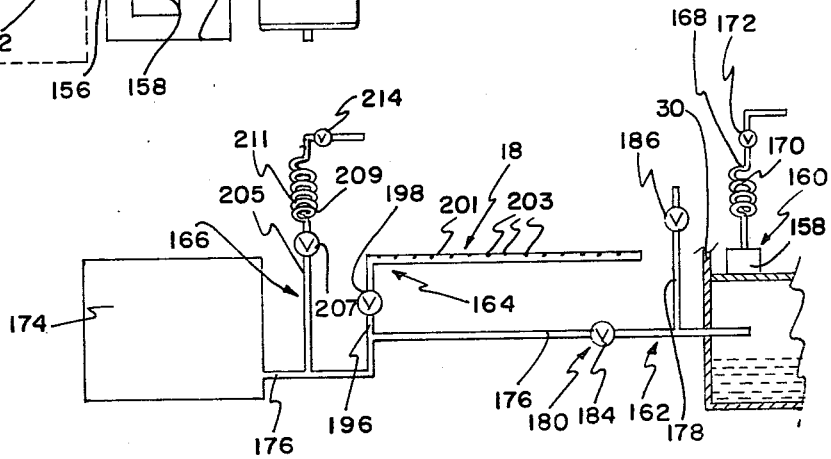

FLUID CLEANER APPARATUS

PRIOR ART

A search of the prior art revealed the following U.S. Pat. Nos.:

| | | | |
|---|---|---|---|
| 2,520,354 | Zinty | 2,720,210 | Lueck |
| 2,559,472 | Shanaman | 4,080,975 | Williams, Jr. |
| 2,567,820 | Messerschmidt | 4,146,404 | Williams, Jr. |

The Lueck and other patents teach the use of air pressure to agitate a cleaning fluid in a parts cleaner.

Also, the movement of a basket member having parts to be cleaned is shown by the Zinty and other references.

However, none of the references teach our means of moving and filtering the cleaning fluid; agitating the cleaning fluid; and rotating the items to be cleaned.

PREFERRED EMBODIMENT OF THE INVENTION

In one preferred embodiment of the invention, a fluid cleaner apparatus is provided which uses a combination of air pressure, fluid pressure, and agitation in order to clean items such as greasy automotive parts or the like. The fluid cleaner apparatus includes (1) a support housing assembly adapted to hold a cleaning fluid and items to be cleaned; (2) a parts support assembly rotatably connected to the support housing assembly; and (3) a fluid actuator assembly operable to supply and control movement of air pressure and cleaning fluid. The support housing assembly includes a parts section mounted on a fluid reservoir section and a lid assembly mounted on the parts section to enclose and seal with same. The parts support assembly is mounted in the parts section adapted to be partially submerged and rotated in the cleaning fluid. The fluid actuator assembly includes (1) an auxiliary fluid assembly to provide cleaning fluid under pressure for cleaning and rinsing; (2) a fluid level assembly operable to control and transfer cleaning fluid between the fluid reservoir section and the parts section; (3) a fluid agitator assembly operable to mix and agitate the cleaning fluid when in the parts section; and (4) an auxiliary air supply to provide pressurized air for drying and cleaning purposes.

OBJECTS OF THE INVENTION

One object of this invention is to provide a fluid cleaner apparatus wherein the cleaning fluid is brought to a desired level in a parts section and provides for the convenient and effective draining from the parts being cleaned and concurrent filtering of the cleaning fluid.

Still, another object of this invention is to provide a fluid cleaner apparatus operable to (1) transfer a cleaning fluid by air pressure from a reservoir section to a parts section having parts to be cleaned therein; (2) rotating the parts through a desired depth of the cleaning fluid; (3) have a work area wherein pressurized air and/or cleaning fluid may be applied to the parts; and (4) transfer the cleaning fluid from the parts section back to the reservoir section through a filter member to clean same.

Another object of this invention is to provide a fluid cleaning apparatus having a rotating drum member to receive parts to be cleaned therein; a safety lid member that must be closed before the drum will rotate; means to precisely adjust the cleaning fluid level relative to the drum member; means to agitate the cleaning fluid about the drum member; and means to concurrently drain and filter the cleaning fluid from about the drum member.

One further object of this invention is to provide a fluid cleaning apparatus that is safe to operate; easy to use; compact in nature having all the elements necessary for a grease cleaning operation; and sturdy in construction.

A still further object of this invention is to provide a fluid cleaner apparatus that uses air pressure to (1) dry parts; (2) agitate the cleaning fluid; and (3) move cleaning fluid from one compartment to another for cleaning and filtering purposes.

Various other objects, advantages, and features of the invention will become apparent to those skilled in the art from the following discussion, taken in conjunction with the accompanying drawings, in which:

FIGURES OF THE INVENTION

FIG. 4 is a side elevational view similar to and opposite of the view set forth in FIG. 2;

FIG. 5 is a fragmentary view of a portion of a basket member of the fluid cleaner apparatus of this invention illustrating a lock member thereon;

FIG. 6 is a schematic diagram of a pump member, a drum power assembly, and a drum control circuit of this invention;

FIG. 7 is a schematic diagram of a fluid actuator assembly of this invention;

Figure 1:
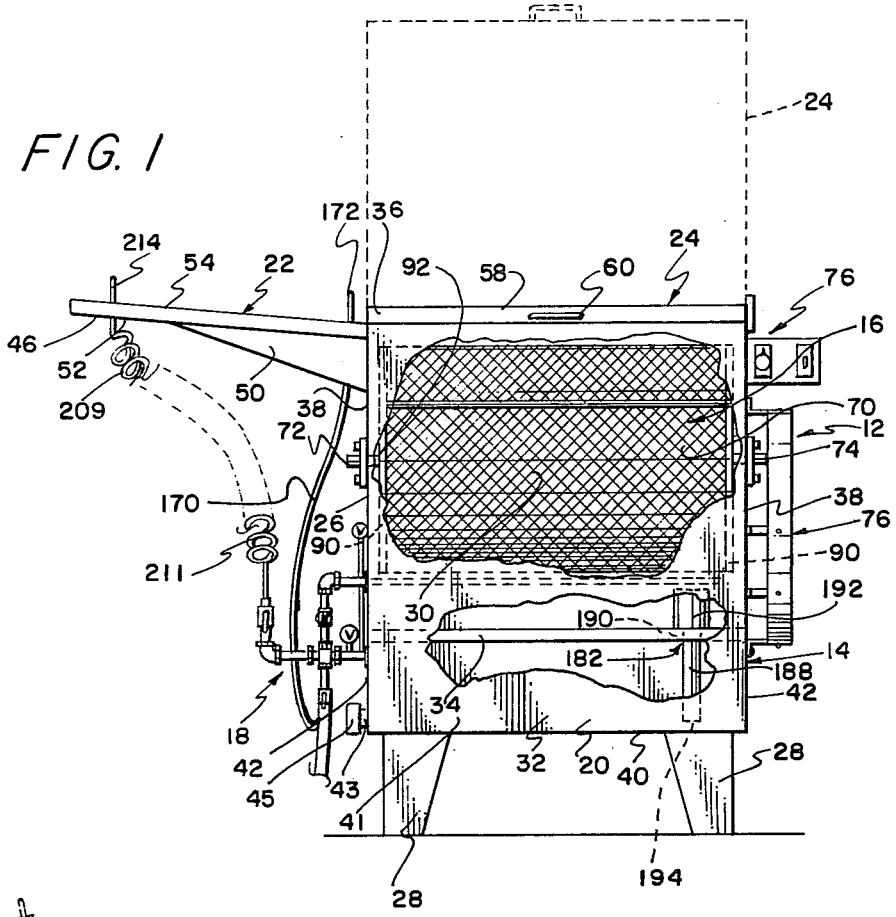
FIG. 1 is a front elevational view of the fluid cleaner apparatus of this invention having portions broken away for clarity and a lid member indicated as opened in dotted lines.

The following is a discussion and description of preferred specific embodiments of the fluid cleaner apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and more particularly to FIG. 1, a fluid cleaner apparatus, indicated generally at 12, presents a compact, complete work bench type structure for cleaning greasy automotive parts or other similar structures. The fluid cleaner apparatus 12 includes (1) a support housing assembly 14; (2) a parts support drum assembly 16 connected to the support housing assembly 14; and (3) a fluid actuactor assembly 18 to supply and control movement of cleaning fluid and pressurized air.

The support housing assembly 14 includes (1) a main support housing 20; (2) a parts support assembly 22 mounted on the main support housing 20; and (3) a lid assembly 24 pivotally connected to the parts support assembly 22. The main support housing 20 includes a basic container member 26 connected to four spaced support legs 28. The basic container member 26 has a parts section 30 mounted on and above a fluid reservoir section 32.

The parts section 30 resembles a rectangular open box with a bottom wall 34; spaced, parallel side walls 36 integral with the bottom wall 34; and spaced parallel end walls 38 integral with both the bottom wall 34 and the side walls 36.

The fluid reservoir section 32 forms an airtight cavity having a bottom wall section 40 secured to the support legs 28; and upright side wall sections 41 and end wall sections 42 secured to each other and to the bottom wall section 40. The fluid reservoir section 32 acts to hold a cleaning fluid 44 for subsequent transfer to the parts section 30 in a manner to be described. A side wall section 41 is formed with a drain pipe 43 and clean out cap 45 which can be removed for maintenance purposes.

The parts support assembly 22 includes a drain plate member 46 secured to an end wall 38 of the parts section 30; a spacer screen 48 mounted on the drain plate member 46; and support lugs 50 secured between the side wall 36 and the drain plate member 46 to add rigidity thereto. The drain pipe member 46 is formed with an inclined support wall 52 having an integral vertically extended lip section 54 about its periphery to direct any cleaning fluid thereon toward the adjacent end wall 38 of the parts section 30.

Figure 2:
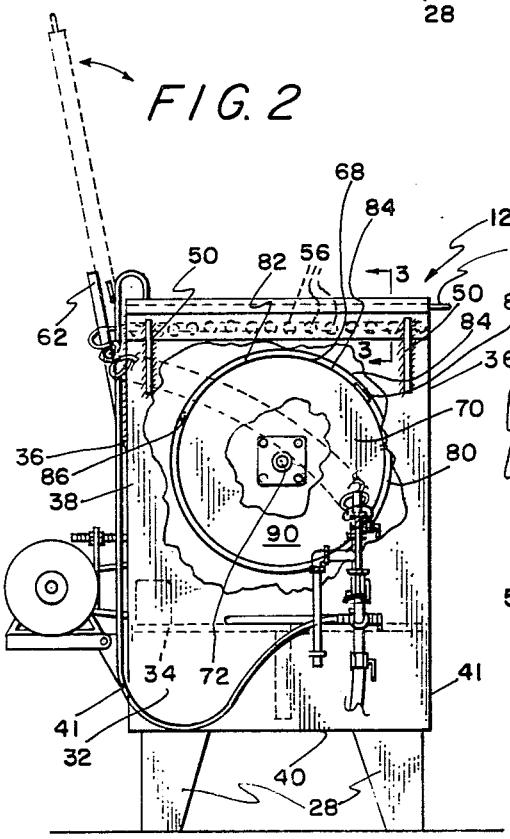
FIG. 2 is a side elevational view of the fluid cleaner apparatus as presented in FIG. 1.
Figure 3:
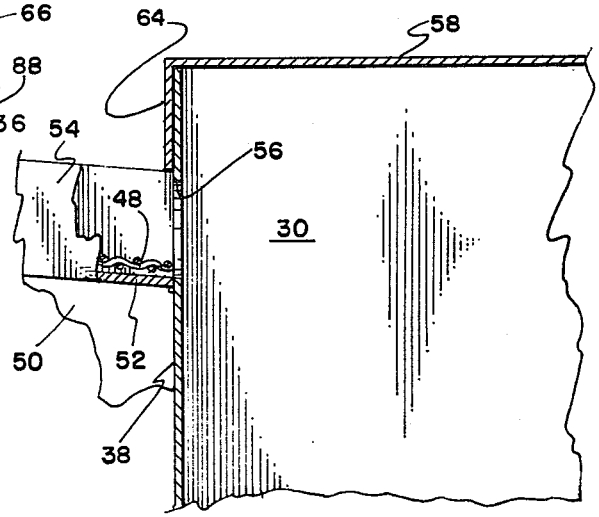
FIG. 3 is an enlarged fragmentary sectional view taken along line 3—3 in FIG. 2.
Figure 8:
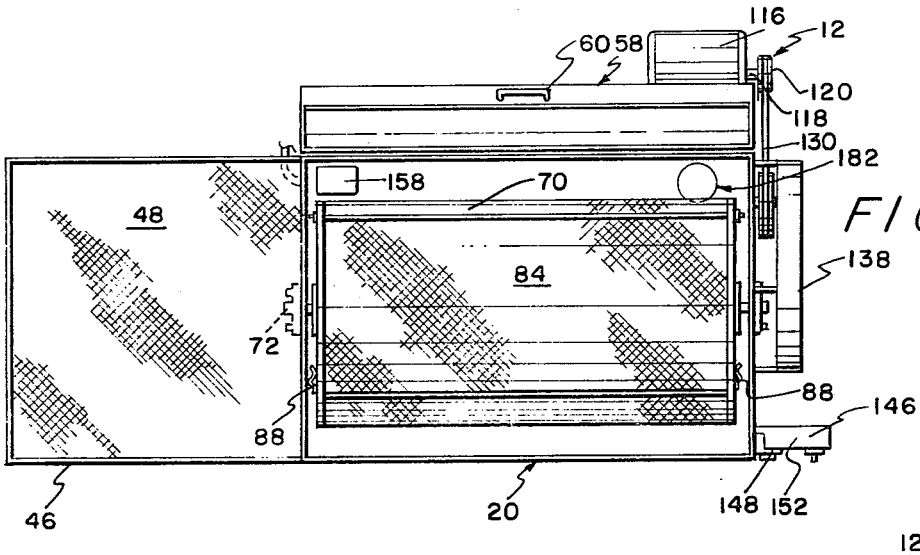
FIG. 8 is a top plan view of the fluid cleaner apparatus of this invention.

As noted in FIGS. 2 and 3, the adjacent end wall 38 is formed with a plurality of drain holes 56 so that any cleaning fluid on the drain plate member 46 flows under gravity back into the parts section 30.

The spacer screen 48 is of a mesh material and operable to elevate a part placed thereon for either draining or additional cleaning operation.

The lid assembly 24 includes a lid member 58 pivotally connected to an upper edge of a side wall 36; a handle member 60 secured to an outer portion of the lid member 58; and a pair of spaced support lugs 62 secured to an outer surface of the subject side wall 36. The lid member 58 is provided with a downwardly depending lip portion 64 to seal around the outside of an upper portion of the parts section 30. (FIG. 3) In this condition as shown in solid lines in FIG. 1, it is obvious that a seal is formed with the lid member 58 and the parts section 30 to aid in keeping the cleaning fluid 44 therein.

It is obvious that the handle member 60 can be grasped to move the lid member 58 to the position shown by the arrow 66 in FIG. 2. Also, the stationary support lugs 62 act as stop members to hold the raised lid member 58 in the dotted line positions as shown in FIGS. 2 and 3.

The parts support drum assembly 16 includes (1) a support drum member 68 having a basket member 70 connected to an elongated support shaft 72; (2) a bearing support assembly 74 secured to opposite ends of the support shaft 72; (3) a drum power assembly 76 connected to one end of the support shaft 72 operable to rotate the basket member 70 thereabout; and (4) a drum control circuit 78 to selectively actuate the drum power assembly 76.

The basket member 70 includes a basket section 80 having an access lid 82 pivotally connected thereto. The access lid 82 includes a lid section 84 connected to the basket section 80 through a hinge member 86 and held in the closed position by a pair of lock members 88.

The lid section 84 and basket section 80 are primarily constructed of a wire mesh material adapted to hold any items being held and cleaned in the basket member 70 while allowing flow of the cleaning fluid 44 therethrough.

The basket section 80 has end walls 90 with support plates 92 therein to which is secured to opposite end portions of the support shaft 72 in order to rotate the entire basket member 70 thereabout.

The bearing support assembly 74 includes a pair of bearing members 94 each secured to a respective opposite end walls 38 of the parts section 30. Each bearing member 94 is adapted to receive and rotatably hold an adjacent portion of the elongated support shaft 72 therein.

As seen in FIG. 5, each lock member 88 includes a main lock body 96 connected at one end portion 98 by a rivet member 101 and having a lock pin section 103 at an opposite end portion 105.

The lid section 84 is provided with a lock hole 106 to receive the lock pin section 103 therein to achieve the locked condition of FIG. 5. It is obvious that the end portion 105 can be pulled outwardly as shown in dotted lines in FIG. 5 to allow the lid section 84 to be raised to gain access to the basket section 80.

As best shown in FIG. 4, the drum power assembly 76 includes a drive motor assembly 108 operably connected to the support shaft 72 by a pulley assembly 110. The drive motor assembly 108 includes a motor member 112 mounted on a support bracket 114 which, in turn, is connected to a side wall section 42 of the fluid reservoir section 32.

The motor member 112 includes an electric motor 116 having a drive shaft 118 connected to a primary drive pulley 120.

The support bracket 114 includes (1) a stationary support plate 122 secured to the side wall section 42; (2) a motor support plate 124 pivotally connected to the support plate 122; and (3) an adjustment assembly 126 mounted between the motor support plate 124 and the basic container member 26. It is obvious that the motor 116 can be pivoted as shown by the arrow 128 in FIG. 4 to tighten a belt member 130 about the drive pulley 120 in a conventional manner.

The pulley assembly 110 includes (1) an intermediate pulley 132 connected to the belt member 130 and rotatably mounted in a bearing member on the basic container member 26; (2) a driven pulley member 134 secured to an outer end of support shaft 72; (3) a driven belt member 136 mounted about the intermediate pulley 132 and the driven pulley member 134; and (4) a belt guard member 138 mounted about the driven belt member 136 and pulley 132 and 134. It is obvious that rotation of the drive pulley 120 by the motor 116 causes rotation of the support drum member 68 through the belt member 130; intermediate pulley 132; belt member 136; and the driven pulley member 134.

As best shown in FIG. 6, the drum control circuit 78 includes (1) a power source 140 to provide 110 volt A-C power at lines 142, 144; (2) an on-off motor switch 146 mounted in line 142; (3) a lid safety switch 148 connected by an electrical line 150 from the motor switch 146; (4) a line 151 to connect the safety switch 148 to the motor 116 to energize same; (5) a pump switch 152 is connected by a line 154 to the line 142; and (6) a line 156 connects the pump switch 152 to a pump member 158. The pump member 158 is also connected to the line 144 so as to be energized on closing of the pump switch 152 in a manner to be disclosed.

The lid safety switch 148 is of a conventional nature having an actuator button or lever to be contacted and closed by the lid member 58 before the motor 116 will be energized. This is a safety feature to prevent the basket member 70 from being rotated with the lid member 58 in the open condition.

The fluid actuator assembly 18 includes (1) an auxiliary fluid assembly 160 to supply fluid under pressure; (2) a fluid level assembly 162 to control fluid movement in the basic container assembly 26; (3) a fluid agitator assembly 164 mounted in the parts section 30 to agitate the cleaning fluid 44 therein; and (4) an auxiliary air supply 166 to provide a separate pressurized air supply.

The auxiliary fluid assembly 160 includes the pump member 158 mounted in the parts section 30 and connected to a discharge hose assembly 168. The discharge hose assembly 168 includes a hose member 170 connected at one end to the pump member 158 and at an outer end to an actuator valve 172. The pump switch 152 or the actuator valve 172 may be used to selectively control the flow of the cleaning fluid 44 from the pump member 158 out the hose member 170.

The fluid level assembly 162 includes (1) a compressor or air supply 174; (2) an air supply line 176 connected to the compressor 174; (3) an air release line 178 connected to the air supply line 176; (4) a control valve assembly 180 mounted respective ones of the air supply line 176 and the air release line 178; and (5) a filter assembly 182 mounted between the parts section 30 and the fluid reservoir section 32 of the basic container member 26.

As noted in FIG. 7, the control valve assembly 180 includes (1) a first control valve 184 mounted in the air supply line 176 to selectively supply pressurized air to the fluid reservoir section 32 to force the cleaning fluid 44 upwardly into the parts section 30; and (2) a second control valve 186 to selectively release air pressure from the fluid reservoir section 32 to the atmosphere for reasons to be explained.

As noted in FIG. 1, the filter assembly 182 includes a stand pipe member 188 extended through a hole 190 in the bottom wall 34 of the parts support section 30; and a filter member 192 releasably connected to an upper portion of the stand pipe member 188. A lower portion 194 of the stand pipe member 188 is placed adjacent the bottom wall section 40 of the fluid reservoir section 32 for reasons to become obvious. The filter member 192 acts to filter the cleaning fluid 44 as it moves downwardly from the parts section 30 to the fluid reservoir section 32 each time the cleaning fluid 44 is transferred therebetween.

The fluid agitator assembly 164 includes an inlet line 196 connected to the air supply line 176; a control valve 198 connected to the inlet line 196 to selectively control movement of pressurized air therethrough; and a discharge pipe member 201 connected to the control to the central valve 198. The discharge pipe member 201 is placed in a lower portion of the parts section 30 and extends the length thereof. The discharge pipe member 201 is provided with a plurality of spaced, discharge holes 203 in order to agitate the cleaning fluid 44 in the parts section 30 in a manner to be described.

The auxiliary air supply 166, as noted in FIG. 7, includes an air inlet line 205 connected to the air supply line 176; a control valve 207 connected to the air inlet line 205; and an expandable hose assembly 209 connected to the output side of the control valve 207. The expandable hose assembly 209 is of a conventional nature having a coiled hose member 211 connected to an actuator valve member 214. The actuator valve member 214 can be placed adjacent to the parts support assembly 22 for ease in drying and removing the cleaning fluid 44 on parts as being held on the drain plate member 46.

USE AND OPERATION OF THE INVENTION

In the use and operation of the fluid cleaner apparatus 12 of this invention, the drum control circuit 78 is provided with energy of normal 110 volt AC type at the lines 142, 144. Also, the compressor 174 is activated to provide air under pressure to the air supply line 176 to present the fluid actuator assembly 18 in working order.

Next, the handle member 60 is used to raise the lid member 58, to a rearwardly, vertically inclined position as shown in dotted lines in FIG. 4. The lid member 58 rests against the support lugs 62 and gravity holds same in this position.

The lock members 88 are moved to the position shown in dotted lines in FIG. 5 to pivot the lid section 84 to an open position. This allows free access to the basket section 80 and numerous items such as greasy automotive parts can be placed therein for cleaning.

Figure 9:
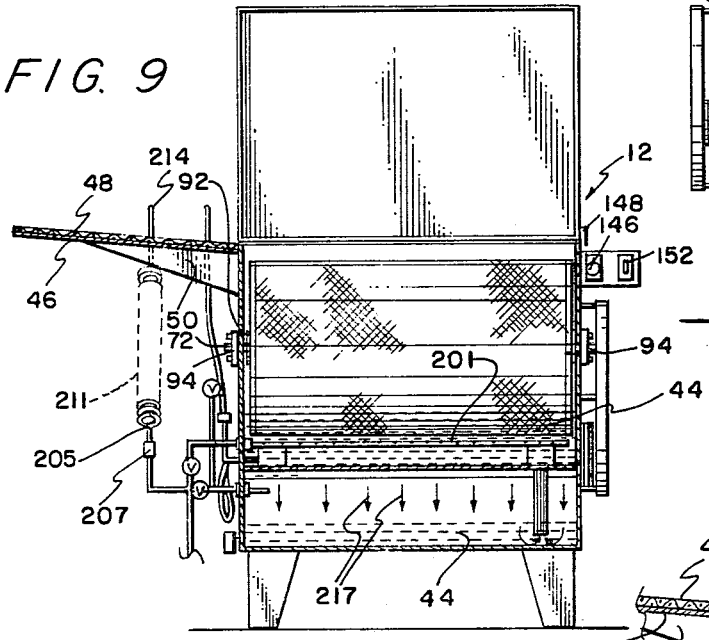
FIGS. 9, 10, and 11 are side elevational views of the fluid cleaner apparatus of this invention with certain elements shown in schematic views thereof to show the use and operation of the invention.
Figure 11:
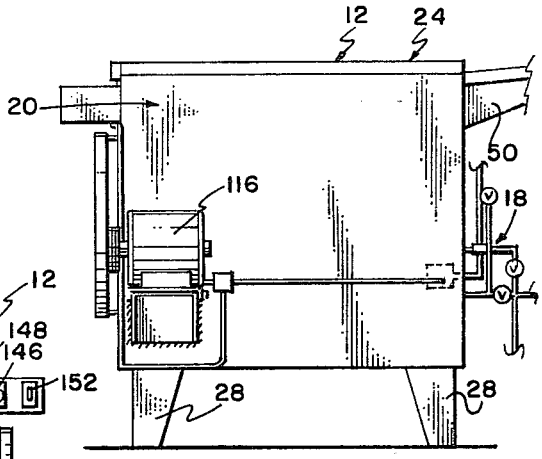

Next, the fluid level assembly 162 is energized by the opening of the first control valve 184 with closing of the second control valve 186. This causes air pressure indicated by the arrows 217 in FIG. 9 to act on a top surface of the cleaning fluid 44 and force same upwardly through the stand pipe member 188 and the filter member 192. The fluid level established in the parts section 30 is controlled by (1) the amount of fluid available in the fluid reservoir section 32; and (2) air pressure against the cleaning fluid 44 in the fluid reservoir section 32.

Figure 10:
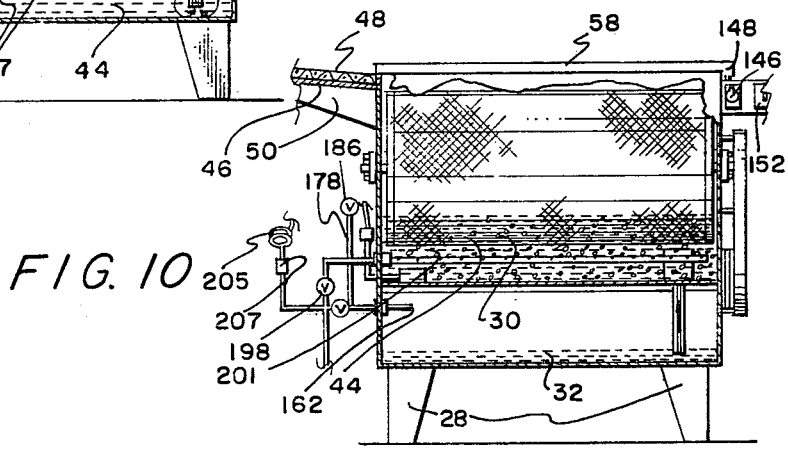

On reaching the fluid levels as shown in FIG. 10, the lid member 58 is closed. This closes the lid safety switch 148 whereby closing the on-off switch 146 energizes the motor 116. This operates through the pulley assembly 110 to cause rotation of the support drum member 68 within the parts section 30 and the cleaning fluid 44.

The motor switch 146 can include a timer structure or variable speed motor control functions if so desired.

Next, the fluid agitation assembly 164 is activated by opening the control valve 198 to a desired amount whereby pressurized air is released in the parts section 30 to move and agitate the parts and cleaning fluid 44 to receive a superior action.

Concurrently with the above, the auxiliary fluid assembly 160 may be energized by the pump switch 152 to dispense pressure fluid from the pump member 152 through the hose member 170. This can be used to rinse or on large parts that cannot fit into the basket section 80.

Also, the auxiliary air supply 166 can be activated by the control valve 207 to supply pressurized air out through an expandable hose assembly 209 to a valve member 214.

After sufficient agitation of the parts in the parts section 30, the motor switch 146 can be turned off to cease rotation of the support drum member 68. The cleaning fluid is then removed from the parts section 30 automatically by opening the second control valve 186 to the atmosphere. The air in the fluid reservoir section 32 gradually reduces to surrounding atmospheric pressure with the cleaning fluid 44 moving through the filter member 192 into the fluid reservoir section 32 under gravity flow.

Concurrently, all the dirt particles in the cleaning fluid 44 in the parts section 30 are collected on the filter member 192 during this fluid movement. The filter member 192 can easily be removed for cleaning or replacement as desired.

Next, the drained, clean parts can be removed from the support drum member 68 for further drying or cleaning on the parts support assembly 22. The spacer screen 48 elevates the parts and any excess cleaning fluid 44 therefrom would flow down the drain plate member 46 and through the drain holes 56 into the parts section 30.

It is seen that the fluid cleaner apparatus of this invention is sturdy in construction, easy to use, safe in operation, and provides all the supplies and elements needed to clean and dry items such as greasy automotive parts. The fluid cleaner apparatus provides a safe structure, compact structure, and being attractive in appearance.

While the invention has been described in conjunction with preferred specific embodiments thereof, it will be understood that this description is intended to illustrate and not to limit the scope of the invention, which is defined by the following claims.

I claim:

1. A fluid cleaner apparatus adapted to clean automotive parts and the like, comprising:

(a) a support housing assembly having a basic container member with a parts section mounted on a fluid reservoir section, each of said parts and fluid reservoir sections operable to have a cleaning fluid therein;

(b) a parts support drum assembly having a parts support member mounted in said parts section whereby the parts to be cleaned can be mounted on said parts section;

(c) a fluid actuator assembly having a fluid level assembly connected to said basic container member; and (d) said fluid level assembly includes fluid supply line connected to said fluid reservoir section to supply pressure fluid thereto and a filter assembly mounted between said fluid reservoir section and said parts section whereby movement of the cleaning fluid from said fluid reservoir section is restricted to movement through said filter assembly;

whereby pressure fluid is supplied through said fluid supply line to force the cleaning fluid into said parts section through said filter assembly for cleaning parts therein; and on release of said pressure fluid from said fluid reservoir section, the cleaning fluid returns to said fluid reservoir section and is concurrently cleaned while passing through said filter assembly.

2. A fluid cleaner apparatus as described in claim 1, wherein:

(a) said support housing assembly includes a lid assembly movable into sealed contact with said parts section as a safety feature to keep out the operator's body and the cleaning fluid in.

3. A fluid cleaner apparatus as described in claim 1, wherein:

(a) said parts support member is a basket member to receive the parts to be cleaned therein;

(b) said basket member rotatably mounted on said parts section; and (c) said parts support drum assembly includes a drum power assembly connected to said basket member to selectively rotate same in the cleaning fluid when present in said parts section.

4. A fluid cleaning apparatus as described in claim 3, wherein:

(a) said support housing assembly includes a lid assembly movable into sealed contact with said parts section as a safety feature to keep out the operator's body and the cleaning fluid in.

(b) said parts support drum assembly includes a drum control circuit having a lid safety switch engagable with said drum power assembly is engaged to rotate said basket member only when said lid assembly is in the closed position in contact with said parts section.

5. A fluid cleaner apparatus as described in claim 3, wherein:

(a) said drum power assembly includes a drive motor assembly connected to a pulley assembly; and (b) said parts support drum assembly includes a drum control circuit having a lid safety switch engageable with said drum power assembly is engaged to rotate said basket member only when said lid assembly is in the closed position in contact with said parts section.

6. A fluid cleaning apparatus as described in claim 1, wherein:

(a) said fluid actuator assembly includes a fluid agitator assembly connected to said pressure fluid and having a discharge pipe mounted in said parts section; and (b) said pressure fluid selectively supplied to said discharge pipe and into the cleaning fluid present in said parts section to agitate same for superior cleaning action.

7. A fluid cleaner apparatus as described in claim 6, wherein:

(a) said support housing assembly includes a lid assembly movable into sealed contact with said parts section as a safety feature to keep out the operator's body and the cleaning fluid in.

8. A fluid cleaner apparatus as described in claim 7, wherein:

(a) said basket member having a basket section with an access lid pivotally connected to said basket section and selectively connected thereto by a lock member; and (b) said basket section and said access lid constructed of a mesh naterial to hold parts therein but permit movement of the cleaning fluid therethrough.

9. A fluid cleaner apparatus as described in claim 1, wherein:

(a) said support housing assembly includes a parts support assembly connected to and extended laterally of basic container member having a spacer screen mounted on a drain plate member; and (b) said drain plate member declined downwardly toward said basic container member whereby any cleaning fluid thereon flow into said container member.

10. A fluid cleaner apparatus as described in claim 9, wherein:

(a) said parts support member is a basket member to receive the parts to be cleaned therein;

(b) said basket member rotatably mounted on said parts section; and (c) said parts support drum assembly includes a drum power assembly connected to said basket member to selectively rotate same in the cleaning fluid when present in said parts section.

11. A fluid cleaner apparatus as described in claim 1, wherein:

(a) said fluid actuator assembly includes an auxiliary fluid assembly having a pump member mounted in said parts section and a pump switch operable to energize said pump member to provide a fluid pressure source for additional cleaning operations.

12. A fluid cleaner apparatus as described in claim 1, wherein:

(a) said fluid actuator assembly includes an auxiliary air supply having pressurized air inlet line connected to an expandable hose assembly to provide air pressure source for additional cleaning purposes.

13. A fluid cleaner apparatus as described in claim 1, wherein:

(a) said filter assembly includes a stand pipe in said fluid reservoir section extended into said parts section and having a filter member secured to an upper end of said stand pipe to filter the cleaning fluid before it moves down into said fluid reservoir section.

14. A fluid cleaner apparatus as described in claim 13, wherein:

(a) a lower end of said stand pipe is placed adjacent a bottom wall of said fluid reservoir section to assure movement of a maximum amount of the cleaning fluid from said fluid reservoir section into said parts section.

15. A fluid cleaner apparatus as described in claim 13, wherein:

(a) said filter member is easily removable for cleaning or replacement.

* * * * *